US007161591B2

(12) United States Patent
Sakaguchi

(10) Patent No.: US 7,161,591 B2
(45) Date of Patent: Jan. 9, 2007

(54) DRIVING DEVICE FOR DISPLAY APPARATUS

(75) Inventor: Nobuhisa Sakaguchi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 274 days.

(21) Appl. No.: 10/348,382

(22) Filed: Jan. 22, 2003

(65) Prior Publication Data

US 2003/0164843 A1 Sep. 4, 2003

(30) Foreign Application Priority Data

Jan. 25, 2002 (JP) ..... 2002-017158

(51) Int. Cl.

| | |
|---|---|
| ***G09G 5/00*** | (2006.01) |
| ***G09G 5/10*** | (2006.01) |
| *G09G 3/20* | (2006.01) |
| *G09G 3/36* | (2006.01) |

(52) U.S. Cl. ..... 345/204; 345/55; 345/87; 345/88; 345/89; 345/98; 345/690

(58) Field of Classification Search ..... 345/204, 345/690, 55, 87–89, 98; 349/73
See application file for complete search history.

(56) References Cited

U.S. PATENT DOCUMENTS

| | | | | |
|---|---|---|---|---|
| 5,184,114 | A * | 2/1993 | Brown | 345/83 |
| 5,737,272 | A * | 4/1998 | Uchiyama et al. | 345/206 |
| 6,169,529 | B1 * | 1/2001 | Hansen et al. | 345/74.1 |
| 6,359,389 | B1 * | 3/2002 | Medina et al. | 315/169.1 |
| 6,727,874 | B1 * | 4/2004 | Okuzono | 345/89 |
| 2001/0048406 | A1 * | 12/2001 | Masumoto et al. | 345/48 |

FOREIGN PATENT DOCUMENTS

| | | |
|---|---|---|
| JP | 2000-122623 | 4/2000 |
| JP | 2001-42833 | 2/2001 |

* cited by examiner

*Primary Examiner*—Richard Hjerpe
*Assistant Examiner*—Alexander S. Beck
(74) *Attorney, Agent, or Firm*—Harness, Dickey & Pierce, P.L.C.

(57) ABSTRACT

This driving device for a display apparatus includes display driving circuit element regions, which are physically separated for a plurality of display data, respectively. In each of the display driving circuit element regions, the driving device includes at least a display data capturing portion for capturing display data corresponding to the region; a holding portion for latching the captured display data for a predetermined period of time; a reference voltage generating portion for generating a predetermined number of reference voltages for gray-scale display; and a selecting portion for selecting a reference voltage corresponding to the latched display data from the generated reference voltages for gray-scale display, wherein the reference voltage selected for each of the plurality of display data is output to the display apparatus as a display driving signal.

14 Claims, 13 Drawing Sheets

DRIVING DEVICE FOR DISPLAY APPARATUS

CROSS-REFERENCE TO RELATED APPLICATION

This application is related to Japanese Patent Application No. 2002-017158 filed on Jan. 25, 2002, whose priority is claimed under 35 USC § 119, the disclosure of which is incorporated by reference in its entirety.

BACKGROUND OF THE INVENTION

1. Field of the Invention

The present invention relates to a driving device for a display apparatus and, more particularly, to a driving device for a display apparatus including a gamma correction function for correcting gray scales of video signals independently for each of three primary colors (red, green and blue).

2. Description of the Related Art

FIG. 6 shows the construction of a conventional liquid crystal display apparatus module. The liquid crystal display apparatus module includes multiple source drivers 51 and gate drivers 52 for directly driving a liquid crystal panel 54 and a controller 56 for supplying drive signals to the drivers 51 and 52.

Each of the source drivers 51 and gate drivers 52 is an LSI device and is provided in a tape carrier package (TCP) 53. The TCP's 53 are implemented in the liquid crystal panel 54.

On the other hand, the controller 56 and wires connecting between the controller 56 and the drivers 51 and 52 are provided on a flexible substrate 55, which is different from the liquid crystal panel 54.

The liquid crystal panel 54 displays by drive signals supplied to source bus lines and gate bus lines, not shown. The source drivers 51 drive the source bus lines. The gate drivers 52 drive the gate bus lines.

In FIG. 6, each of the source drivers 51 is rectangular. Wires extending from the above in FIG. 6 are input lines for signals input from the controller circuit 56. Many wires extending from the bottom of the rectangular source driver 51 are output lines to the liquid crystal panel 54.

FIG. 7 is a plan view showing a layout of terminals of the source driver 51 of the conventional liquid crystal display apparatus module. In FIG. 7, a driving circuit element region 40 is located at the center of the rectangular source driver 51. Many electrode pads 100 are provided along four sides of the rectangle.

In FIG. 7, the electrode pads for output terminals 41 are provided along the left, right and upper sides of the rectangle. Power supply terminals 42, input control terminals 43 and reference power supply terminals 44 are provided along the bottom side of the rectangle.

Gold bumps, not shown, are plated on each of the electrode pads 100. Each of the gold bumps is about 40 to 90 μm long and wide and about 10 to 20 μm high.

FIG. 8 is a schematic diagram of component circuit blocks in the driving circuit element region 40 of the conventional source driver. The circuit blocks of the source driver 51 are mainly a shift register circuit 61, a data latch circuit 62, a sampling memory circuit 63, a hold memory circuit 64, a reference voltage generating circuit 65, a D/A converter circuit 66 and an output circuit 67.

Here, each of the circuit blocks is separately modularized and is laid out in one LSI in general. The LSI is designed generally by using circuit blocks each registered as a macro cell for the CAD design. When the macro cells are reused and the circuit blocks are laid out together as many as possible, operation within each of the circuit blocks is stabilized. Thus, the LSI can operate in accordance with the design specification.

The circuit blocks are laid out such that wires between the circuit blocks within the driving circuit element region 40 and wires between surrounding terminals and the circuit blocks can be the shortest possible.

The source driver 51 includes many output terminals 41, and must be mounted in a narrower frame region of the liquid crystal panel 54. Thus, the source driver 51 has a significantly long and narrow chip form.

In view of the above-mentioned wires and limitations, the conventional source driver 51 in FIG. 8 has the reference voltage circuit 65 and data latch circuit 62 for processing analog voltage at the center of the chip. The rest of the circuit blocks are located at the left and right symmetrically. Thus, an equivalent amount of effect from wire resistance and so on can be given on each of the circuit blocks.

In each of the gate drivers 52, circuit blocks are laid out in view of wires and so on like each of the source drivers 51.

Terminals of indium tin oxide (ITO) are located on the liquid crystal panel 54. The ITO terminals are electrically connected to the output terminals to the liquid crystal panel 54 side of the source driver 51 and gate driver 52 through the wires on the TCP 53.

The ITO terminals and the wires on the TCP 53 are thermally press-fitted and are electrically connected through an anisotropic conductive film (ACF).

The terminals to the flexible substrate 55 within the source driver 51 and gate driver 52 are electrically connected to wires on the flexible substrate 55 through wires on the TCP's 53 by the ACF or soldering.

As described above, signal lines output from the controller circuit 56 are connected to the terminals of the source drivers 51 and gate drivers 52 by using the wires on the flexible substrate 55. The output signal lines from both of the drivers 51 and 52 are connected to the ITO terminals on the liquid crystal panel 54 through the wires on the TCP's 53.

Display data signals (three signals of R, G and B), different kinds of control signals and power supplies (GND and VCC) are supplied from the controller circuit 56 to each of the source drivers 51 through the wires. Different kinds of control signals and power supplies are supplied to each of the gate drivers 52 through the wires.

The construction shown in FIG. 6 includes eight source drivers 51 (S1 to S8) and two gate drivers 52 (G1 and G2). Each of the source drivers 51 includes the same circuit blocks. Display data signals (R, G and B), start pulse input signals SSPI and clock signals SCK are supplied from the controller circuit 56 to each of the source drivers 51.

Each of the two gate drivers 52 includes the same circuit blocks. Clock signals GCK and start pulse input signals GSPI are supplied from the controller circuit 56 to each of the gate drivers 52.

FIG. 9 is an explanatory diagram of output terminals of the conventional controller circuit 56. Here, nine output terminals R1 to R6 to SCK are connected to the source drivers 51. Four output terminals from GCK to GSPI are connected to the gate drivers 52.

The terminals R1 to R6, G1 to G6, and B1 to B6 output display data signals R, G and B of 6 bits each, respectively. The terminal LS outputs latch signals. Nine terminals Vref1 to Vref9 output halftone reference voltages to be supplied to the source drivers 51. Similarly, the lower two terminals Vref1 and Vref2 output reference voltages to the gate drivers 52.

When 1024×768 pixels are provided in the liquid crystal panel 54 for each of the three primary colors, the source side (the horizontal direction in FIG. 6) has 1024 pixels ×3 in total. The gate side (the vertical direction in FIG. 6) has 768 pixels.

Here, when the eight source drivers 51 (S1 to S8) drives the pixels of the source side (1024 pixels ×3), each of the source drivers 51 is responsible for 128 pixels ×3 (RGB). Each color includes 6-bit display data signals (R1 to R6, for example). Thus, each of the source drivers 51 displays 64 gray scales.

FIG. 10 is a diagram functionally showing an construction of the circuit blocks of the conventional source driver 51 shown in FIG. 7. The source driver 51 includes the seven functional circuit blocks as shown in FIG. 7.

As shown in FIG. 10, the source driver 51 includes input terminals from SSPin to Vref1 to Vref9 on the left and output terminals SSIO on the right and X0-1 to Z0-128 at the bottom.

Operation of the first source driver 51 will be described, for example.

A start pulse input signal SSPI is input from the controller circuit 56 to the SSPin terminal of the source driver 51. The SSPI signal is synchronized with horizontal synchronous signals of display data signals R, G and B. A clock signal SCK is input to the input terminal SSKin. The shift register circuit 61 uses the clock signal SCK to shift (propagate) the start pulse input signal SSPI and outputs it to the output terminal SSIO as an SSPO signal.

The start pulse input signal SSPI shifted by the shift register circuit 61 is sequentially transferred to the shift register circuits 61 upto the eighth source driver S8. On the other hand, display data signals R, G and B, of 6 bits each, output from the terminals R1 to R6, terminals G1 to G6 and terminals B1 to B6, respectively, of the controller circuit 56 are synchronized with a rising edge of an invert signal (/SCK) of the clock signal SCK and are input to the input terminals R1in to R6in, input terminals G1in to G6in and input terminals B1in to B6in, respectively, of the source driver 51 in series. The display data signals R, G and B are latched in the data latch circuit 62 temporarily and then are sent to the sampling memory circuit 63.

The sampling memory circuit 63 samples the display data signals (that is, R, G and B signals of 6 bits each and 18 bits in total) sent in a time-division manner, from output signals of stages of the shift register. The sampling memory circuit 63 stores the display data signals until a latch signal LS is input from the controller circuit 56 to the hold memory circuit 64.

When the latch signal LS is input to the hold memory circuit 64, the display data stored in the sampling memory circuit 63 is input to the hold memory circuit 64. Thus, the display data signals for one horizontal period of the display data signals R, G and B are latched, that is, are held.

When the display data signals for the next one horizontal period are input from the sampling memory circuit 63, the held display data signals are output to the D/A converter circuit 66.

Halftone reference voltages output from the terminals Vref1 to Vref9 of the controller circuit 56 are input to the terminals Vref1 to Vref9 of the source driver 51 in FIG. 10 and are supplied to the reference voltage generating circuit 65. The reference voltage generating circuit 65 generates 64 levels of gray-scale display reference voltage based on the reference voltages by using a resistance dividing circuit, for example.

The D/A converter circuit 66 converts the R, G and B display data signals (digital) of 6 bits each input from the hold memory circuit 64 to analog signals accordingly and outputs to the output circuit 67. The output circuit 67 amplifies the 64 level analog signals and outputs to terminals, not shown, of the liquid crystal panel 54 through the output terminals Xo-1 to Xo-128, Yo-1 to Yo-128 and Zo-1 to Zo-128. The output terminals Xo-1 to Xo-128, Yo-1 to Yo-128 and Zo-1 to Zo-128 correspond to R, G and B display data signals, respectively, and each of the output terminal sets Xo, Yo and Xo includes 128 terminals.

The terminal VCC and terminal GND of the source driver 51 are terminals for power supply connected to the terminal VCC and terminal GND of the controller circuit 56. Power supply voltage and ground potential are supplied to the terminal VCC and terminal GND of the source driver 51, respectively.

FIG. 11 is a schematic block diagram showing a construction of the inside of the conventional reference voltage generating circuit 65. FIG. 12 is a schematic diagram showing a construction of the conventional D/A converter 66 and the output circuit 67. These circuits 65, 66 and 67 convert and output display data (Bit0 to Bit 5 in FIG. 12) supplied as digital signals to analog voltage values.

The D/A converter circuit 66 selects and outputs one of the 64 gray-scale display reference voltages generated by the reference voltage generating circuit 65. The D/A converter circuit 66 includes a MOS transistor. The output circuit 67 includes a so-called voltage follower circuit.

In FIG. 12, the output circuit 67 outputs the analog voltage value selected by the D/A converter circuit 66 of the 64 level analog voltages corresponding to the values of the supplied display data (Bit0 to Bit5).

The output circuit 67 reduces the impedance of the voltage selected by the D/A converter circuit 66 and outputs to the liquid panel side through the terminals (Xo-1 to Xo-128 and so on) for outputting liquid crystal driving voltage shown in FIG. 10.

Here, typically, the reference voltage generating circuit 65 is commonly used for the multiple terminals for outputting liquid crystal driving voltages. However, one D/A converter circuit 66 and one output circuit 67 are used for each of the terminals for outputting liquid crystal driving voltages.

Furthermore, for color display, the terminals for outputting liquid crystal driving voltages are used for colors, respectively. The D/A converter circuit 66 and output circuit 67 display one color for each pixel. Therefore, one D/A converter circuit 66 and one output circuit 67 are used for each color.

In other words, when the liquid crystal panel 54 includes 3N pixels horizontally, N terminals for outputting liquid crystal driving voltages are used each of red R1 to RN, green G1 to GN and blue B1 to BN. That is, 3N terminals for outputting liquid crystal driving voltages are used in total. Therefore, 3N D/A converter circuits 66 and 3N output circuits 67 are required.

The reference voltage generating circuit 65 shown in FIG. 11 has nine halftone voltage input terminals (Vref1 to Vref9) and resistance elements (R0 to R7) having resistance ratios for γ correction and being connected in series.

The resistance elements R0, R1, . . . and R7 are represented as resistances having resistance values in accordance with γ corrections, respectively, in FIG. 11. However, in reality, each of the resistance elements R0 to R7 further includes multiple resistances equally dividing the voltage into eight voltages between halftone voltage terminals Vref into eight. The conventional reference voltage generating circuit 65 generates gray-scale display voltages for the y corrections. One voltage generating circuit 65 is provided in each source driver and is shared by R, G and B processing circuits.

FIG. 13 shows a graph of a gray-scale voltage characteristic in the conventional source driver 51. The horizontal axis indicates gray-scale display data (digital values) input to the source driver 51. The vertical axis indicates analog voltage values (liquid crystal driving output voltages) after γ correction corresponding to the display data.

Here, V0 to V63 in the vertical axis correspond to reference voltages Vref of the reference voltage generating circuit 65. The reference voltages Vref1, Vref2, Vref3, Vref4, Vref5, Vref6, Vref7, Vref8 and Vref9 correspond to V0, V8, V16, V24, V32, V40, V48, V56 and V63, respectively.

The characteristics in FIG. 13 are plotted in the line graph in which the resistance elements for γ correction have different resistance ratios in order to display natural gray scales in view of an optical characteristic of a liquid crystal material.

As shown in FIG. 11, 64 levels (V0 to V63) of gray-scale display reference voltage are output from the reference voltage generating circuit 65. These outputs are input to the D/A converter 66. The D/A converter circuit 66 selects and outputs one of the input 64 levels of reference voltage in accordance with the type of the display data (Bit 0 to Bit5).

As shown in FIG. 12, the D/A converter circuit 66 includes many switches. Each switch includes a MOS transistor. In the D/A converter circuit 66, the switches corresponding to 6-bit digital signals Bit0 to Bit5 are turned ON or OFF in accordance with the values of the 6-bit digital signals Bit0 to Bit5. In accordance with a combination of these switches, one of the input 64 levels of reference voltage is selected and is output.

As described above, the output circuit 67 reduces the impedance of the selected reference voltage by using the voltage follower circuit. This reduction is for charging the pixels and wire capacitance of the liquid crystal panel, and increasing speed for leading the driving voltage to a predetermined voltage.

The source driver 51 having the above-described construction and performing the above-described operation has a large number of output terminals as shown in FIG. 8. These output terminals and terminals of the liquid crystal panel 54 must be connected through the shortest possible wires efficiently. For this purpose, the source driver 51 is laid out such that the upper long side of the rectangular source driver 51 having the output terminals 41 in FIG. 8 can face against the liquid crystal panel 54. The lower long side in FIG. 8 has the power supply terminals 42 and so on. This lower long side does not face against the liquid panel 54.

On the other hand, as shown in FIG. 6, multiple source drivers are cascade-connected. A start pulse signal is transferred sequentially from one source driver to another.

Therefore, in the lay-out of the circuit blocks in the source driver 51, in view of a signal processing flow, the shift resistor circuits 61 are laid out in parallel at the lower long side, which does not face against the liquid crystal panel 54.

Signals pass through the sampling memory circuit 63, the hold memory circuit 64, the D/A converter circuit 66 and the output circuit 67 in order. Thus, as shown in FIG. 8, these circuit blocks are laid out in a direction perpendicular to the chip long side.

Presently, a liquid crystal display apparatus having higher resolution and larger screen is demanded. In addition, the cost reduction is requested. As the size of a screen is increased, the number of pixels of a panel is increased. As a result, the number of output terminals handled by one source driver increases.

In order to meet the request for the cost reduction, the number of source drivers must be reduced. In order to reduce the number of source drivers, the number of output terminals included in one source driver must be increased.

As for the respective circuit block of the source driver such as source driver 51, one circuit block corresponds to one output except for the reference voltage generating circuit 65. Therefore, as the number of output terminals 41 increases, the number of circuits increases. As the number of output terminals 41 increases, the number of levels of the shift resistor circuit 61 increases. Thus, the shift register circuit 61 has a long and narrow layout. Also, the other circuit blocks are laid out in a horizontally oriented form.

Furthermore, when the number of output terminals 41 of the source driver 51 increases, the length of the long side of the chip is increased. Therefore, the chip becomes significantly long and narrow. For example, when bumps of the chip and inner leads of a tape base are electrically connected to be a TCP, difficulties in chip handling, height control between the chip and the inner leads of the tape base and control over the pitch precision of the inner leads are increased.

In order to avoid these kinds of inconvenience and in order to achieve the increase in the number of output terminals, an increase in ratio of the long side to the short side must be suppressed.

On the other hand, improved quality of liquid crystal display is also requested strongly with respect to γ correction.

As described above, in order to achieve the natural gray-scale display, γ correction is performed in accordance with an optical characteristic of a liquid crystal material. The γ correction depends on voltage-transmissivity characteristic (V-T characteristic) of each liquid crystal display device. However, the V-T characteristic varies largely in producing liquid crystal display devices. The V-T characteristic differs largely for each liquid crystal display device. Determining a resistance ratio uniquely for γ correction is difficult. Thus, it is difficult to maintain constant quality with respect to γ correction.

The V-T characteristic may also depend on variation of each light incident on a liquid crystal display device and variation of characteristics of an optical system, etc.

Therefore, increasing the screen size and resolution an increase in the number of pixels. This may be disadvantageous to achieving a more proper gray-scale display.

SUMMARY OF THE INVENTION

In the present invention, there is provided a driving device for a display apparatus including display driving circuit element regions, physically separated for a plurality of display data. The apparatus includes, in each of the display driving circuit element regions, at least a display data capturing portion for capturing display data corresponding to the region, a holding portion for latching the captured display data for a predetermined period of time, a reference voltage generating portion for generating a predetermined number of reference voltages for gray-scale display, and a selecting portion for selecting a reference voltage corresponding to the latched display data from the generated reference voltages for gray-scale display, wherein the reference voltage selected for each of the plurality of display data is output to the display apparatus as a display driving signal.

In each of the display driving circuit element regions, the display data capturing portion, the holding portion, the reference voltage generating portion and the selecting portion may be physically separated.

Thus, the form of the device can be prevented from being long and narrow excessively. A set of circuit blocks including the display data capturing portion is provided for each display data. Therefore, images can be displayed in more proper and natural gray scales.

DESCRIPTION OF THE EXAMPLE EMBODIMENTS

Figure 1:
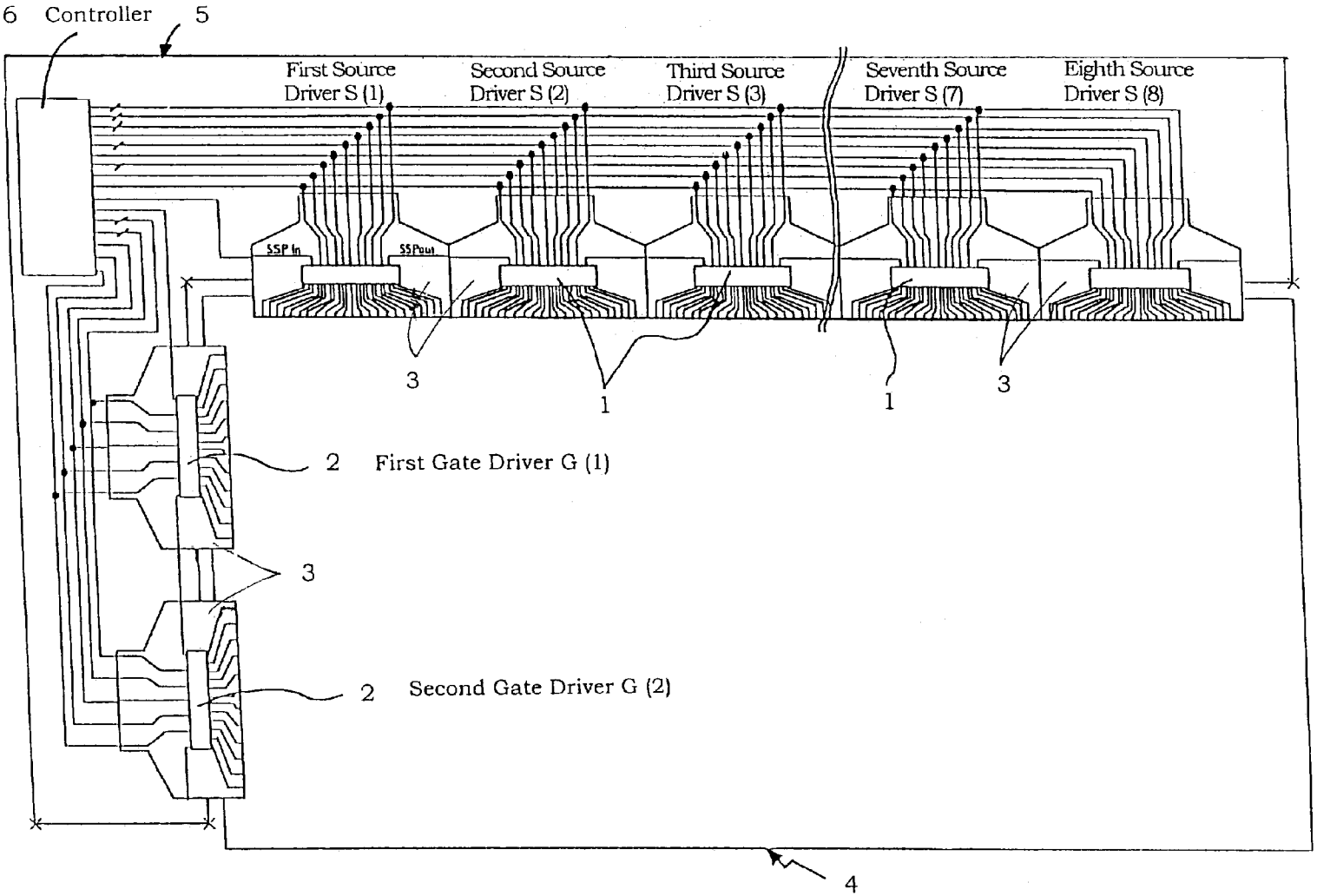
FIG. 1 is a block diagram showing a construction of a liquid crystal display apparatus according to an embodiment of the present invention.

The present invention provides a driving device for a display apparatus having γ-correction functions for three primary colors, respectively and independently. Thus, an image can be displayed in proper gray-scales regardless of increases in screen size, resolution, etc.

The driving device for a display apparatus may be formed of a rectangular semiconductor device, and the display driving circuit element regions may be aligned in parallel in a direction of a short side of the rectangular semiconductor device.

In each of the divided display driving circuit element regions, the display data capturing portion, the holding portion, the reference voltage generating portion and the selecting portion may be aligned in parallel in the direction of the short side of the rectangular semiconductor device.

When the plurality of display data are data classified according to provided for each of color components, the display driving circuit element regions may be separated for each of the color components.

According to another aspect of the present invention, there is provided a display apparatus including a driving device for a display apparatus as described above.

The driving device for a display apparatus according to the present invention may be provided as an LSI device including a set of macro-cell semiconductor elements formed as function modules (circuit blocks).

The driving device for a display apparatus is located between a so-called controller for generating display data and/or different kinds of control signals and the display apparatus for displaying display data visually. The driving device controls inputs and outputs of display data and the like. The driving device includes many input/output terminals. The number of the input/output terminals depends on the number of pixels and the number of gray-scales of the display apparatus. The driving device is an LSI device packaged in a rectangular form in general.

The driving device may be used for various kinds of display apparatus. In an example, when the driving device is used for a liquid crystal panel, which is one of the display apparatus, the driving device can be used as a so-called source driver and gate driver.

When the driving device according to the present invention is used as a source driver of a liquid crystal panel for performing color-display by using three primary color components (red, green, bleu), the circuit blocks are physically separated in an element region for driving to display the red component, an element region for driving to display the green component and an element region for driving to display the blue component, respectively, within the LSI device as the driving device.

In example, in order to prevent the rectangular form of the LSI package from being excessively long and narrow, the element regions for the three color components may be aligned not in the long side direction of the rectangular forms, but in parallel with the short side direction of the rectangular form.

In order to prevent the package form of the LSI device from being excessively long and narrow, the input/output terminals for connecting to the controller and/or the display apparatus may be separately provided in the element regions each corresponding to one of the color components.

Like the conventional technology, the function modules within the driving device include circuit blocks such as the display data capturing portion, holding portion, selecting portion and reference voltage generating portion. In order to perform γ-correction of gray-scales on each color and to perform detail settings for each color for improving display quality, a set of these circuit blocks is provided in each of the element regions for each color component. Furthermore, in view of a flow order of signal processing, these circuit blocks may be provided separately but adjacently in each of the element regions.

According to an embodiment of the present invention, described later, the display data capturing portion corresponds to a shift register circuit and display data input terminals (R1in to R6in, G1in to G6in, and B1in to B6in). The holding portion corresponds to a data latch circuit, a sampling memory circuit and a hold memory circuit. The reference voltage generating portion corresponds to a reference voltage generating circuit. The selecting portion corresponds to a D/A converter circuit.

The present invention will be described below in detail based on an embodiment shown in drawings. However, the present invention is not limited thereby.

Figure 6:
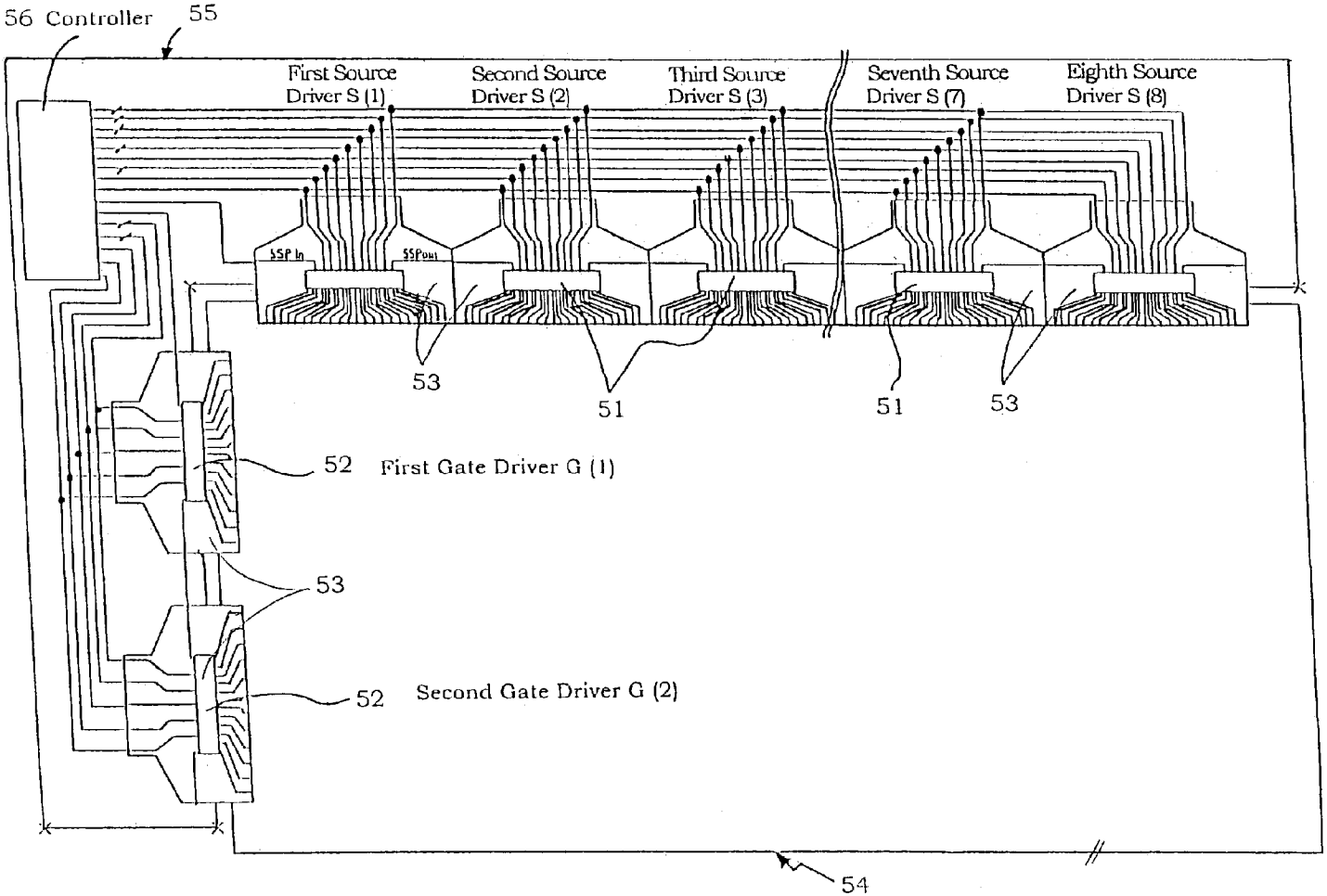
Fig. 6 Prior Art
FIG. 6 is a block diagram showing a construction of a conventional liquid crystal display apparatus module.
Figure 7:
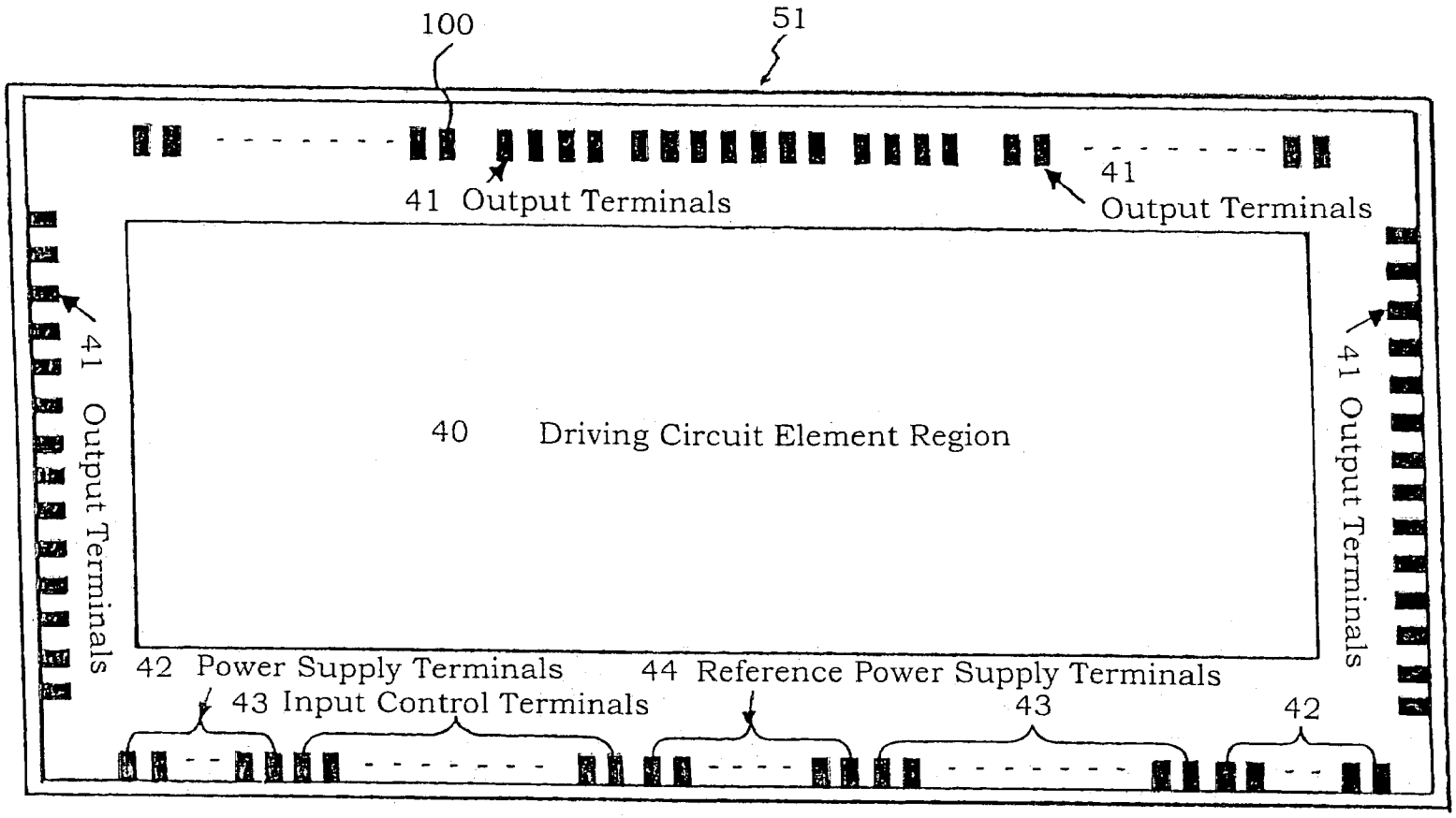
Fig. 7 Prior Art
FIG. 7 is a plan view showing a layout of terminals of a driving device (source driver) for a display apparatus of the conventional liquid crystal display apparatus module.

FIG. 1 shows a block diagram showing a construction of a liquid crystal display apparatus according to an embodiment of the present invention. Like the conventional liquid crystal display apparatus shown in FIG. 6, the liquid crystal display apparatus according to this embodiment includes a liquid crystal panel 4, a flexible substrate 5 and TCP's 3. Source drivers 1 (S1 to S8) and gate drivers 2 (G1 and G2) are provided on the TCP's 3. A controller 6 and wires to the TCP's 3 are provided on the flexible substrate 5.

The TCP's 3 have wires between the flexible substrate 5 and the source drivers 1 and between flexible substrate 5 and the gate drivers 2 and have wires between the liquid crystal panel 4 and the source drivers 1 and between the liquid crystal panel 4 and the gate drivers 2. The source drivers 1 drive source bus lines within the liquid crystal panel 4 as conventional. The gate drivers 2 drive gate bus lines within the liquid crystal panel 4.

Figure 2:
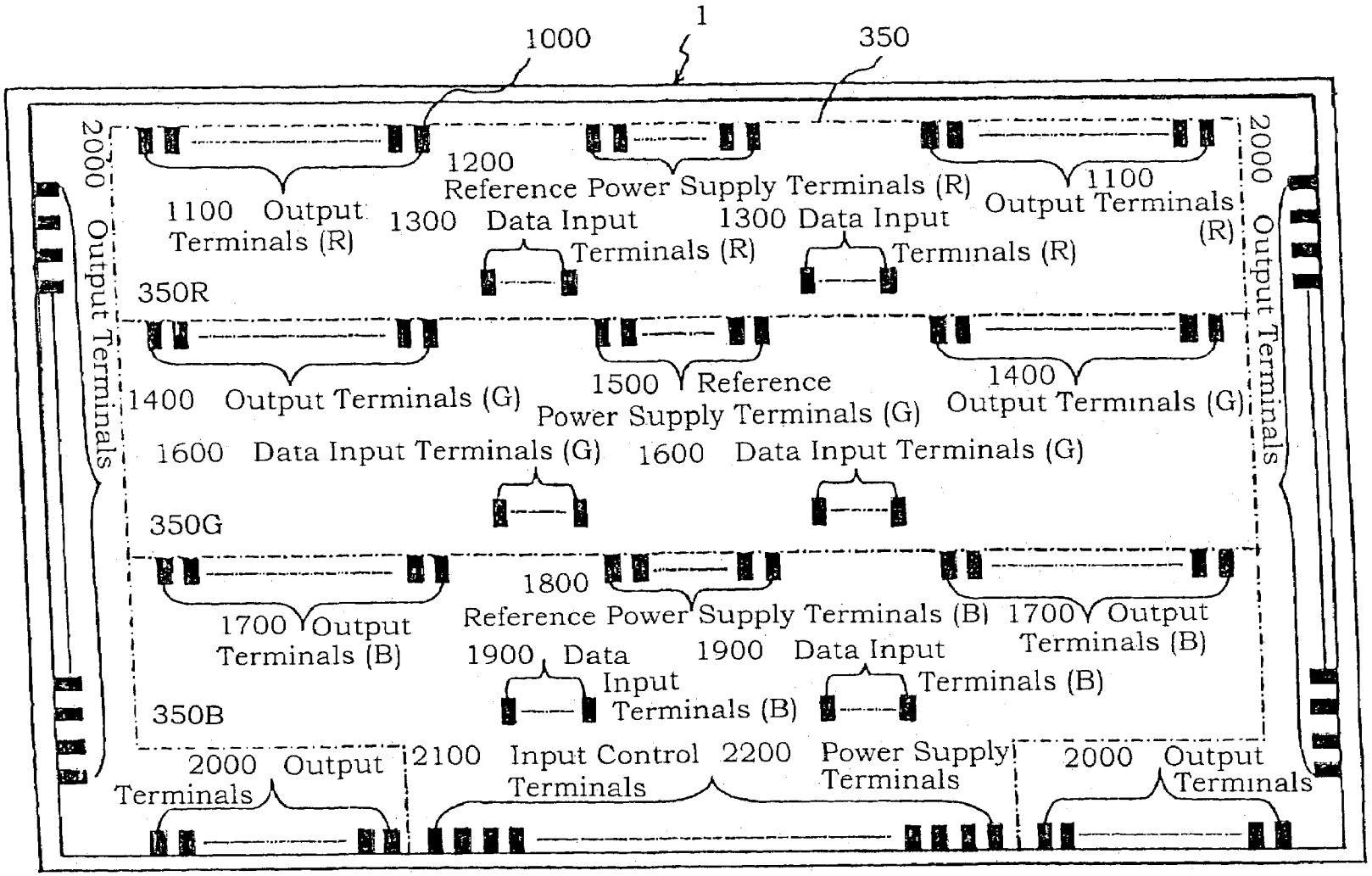
FIG. 2 is a plan view showing a layout of terminals of a driving device (source driver) for a display apparatus according to the embodiment of the present invention.

FIG. 2 shows a plan view of a layout of terminals of each of the source drivers 1 according to this embodiment of the present invention. The source driver 1 has a horizontally-oriented rectangular form, as shown in FIG. 1. The source driver 1 includes various circuit elements and many electrode pads 1000 inside as shown in FIG. 2.

The electrode pads 1000 have gold bumps formed by plating. Each of the gold bumps is rectangular and is about 40 to 90 μm wide and long and about 10 to 20 μm high. However, the size including the height of the gold bump depends on the design specification of the bump pitch and is not limited thereto.

The electrode pads 1000 are categorized into five kinds of terminals including output terminals, reference power supply terminals, data input terminals, input control terminals and power supply terminals. According to the invention, a set of the output terminals, reference voltage terminals and data input terminals are formed in separate regions for the three primary colors (R, G and B).

In FIG. 2, a driving circuit element region 350 is located at a substantial center of the rectangular source driver 1. The driving circuit element region 350 is divided into three regions including a red region 350R responsible for driving red display elements, a green region 350G responsible for driving green display elements and a blue region 350B responsible for driving blue display elements.

The red region 350R includes circuit blocks (see FIG. 3) for driving to display red, output terminals (R) 1100, reference voltage terminals (R) 1200 and data input terminals (R) 1300 for red.

Similarly, the green region 350G includes circuit blocks for driving to display green, output terminals (G) 1400, reference voltage terminals (G) 1500 and data input terminals (G) 1600 for green, and the blue region 350B includes circuit blocks for driving to display blue, output terminals (B) 1700, reference voltage terminals (B) 1800 and data input terminals (B) 1900 for blue.

In other words, according to the invention, a set of the driving circuit blocks and the terminals is located separately for each color. Here, the red region 350R, green region 350G and blue region 350B are designed as the completely same macro cells having the same circuit construction and layout inside. In other words, only one kind of macro cell is designed, and the three macro cells are aligned to form the driving circuit element region 350.

As shown in FIG. 2, output terminals 2000 are located along the short sides of the rectangular source driver. The output terminals 2000 are used as dummy and auxiliary terminals. A part of the output terminals 2000, input control terminals 2100 and power supply terminals 2200 are located along one of the long sides of the rectangular source driver.

Figure 3:
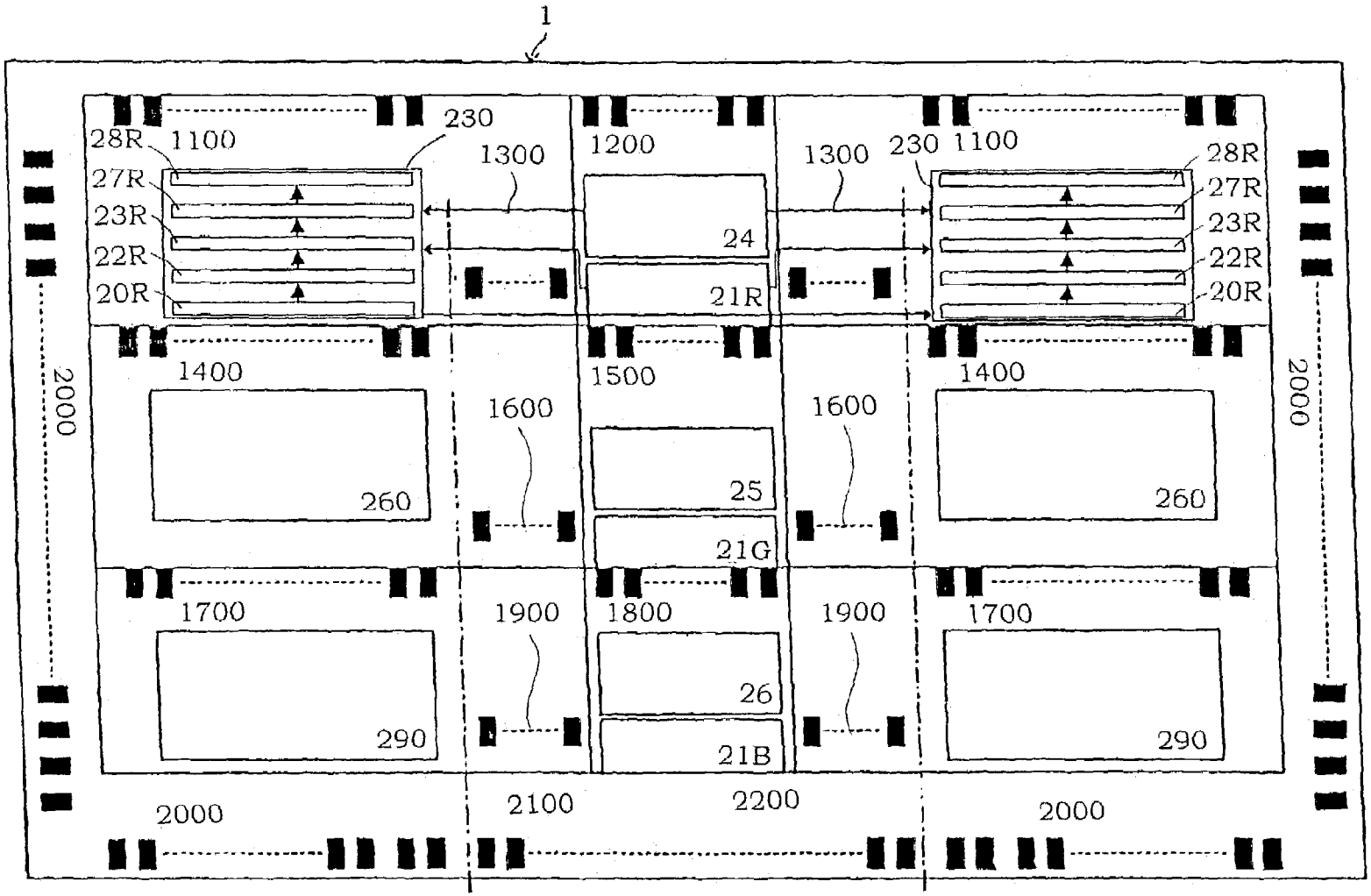
FIG. 3 is a plan view showing a construction of a driving circuit element region of the driving device for the display apparatus according to the embodiment of the present invention.

FIG. 3 shows a plan view of an illustrative circuit block construction in the driving circuit element region 350 of the source driver 1 according to this embodiment.

As described above, the driving circuit element region 350 is divided into three regions of the red region 350R, the green region 350G and the blue region 350B. The red region 350R includes an R-circuit block 230, a data latch circuit (R) 21R and a reference voltage generating circuit (R) 24 in addition to the above-mentioned terminals (1100, 1200 and 1300). The layout of the circuit blocks is shown in FIG. 3 for an illustrative purpose only and not limited thereto.

Here, the R-circuit block 230 receives an input of red display data from the data latch circuit (R) 21R and drives red display elements. The data latch circuit (R) 21R holds red serial data input to the source driver 1. The reference voltage generating circuit (R) 24 generates gray-scale voltages corresponding to red display elements.

Figure 8:
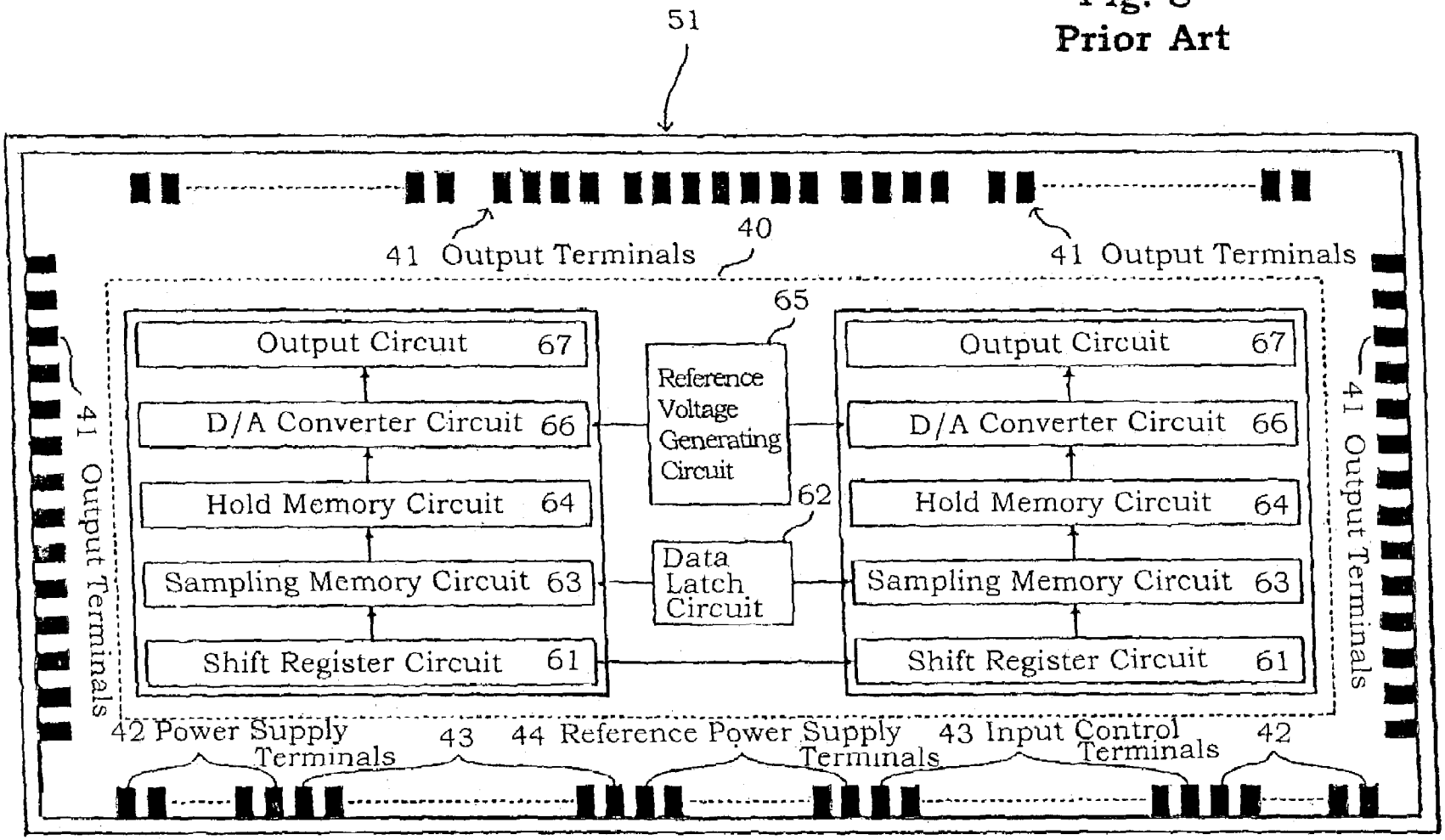
Fig. 8 Prior Art
FIG. 8 is a plan view showing component circuit blocks of a driving circuit element region of the conventional driving device (source driver) for a display apparatus.
Figure 9:
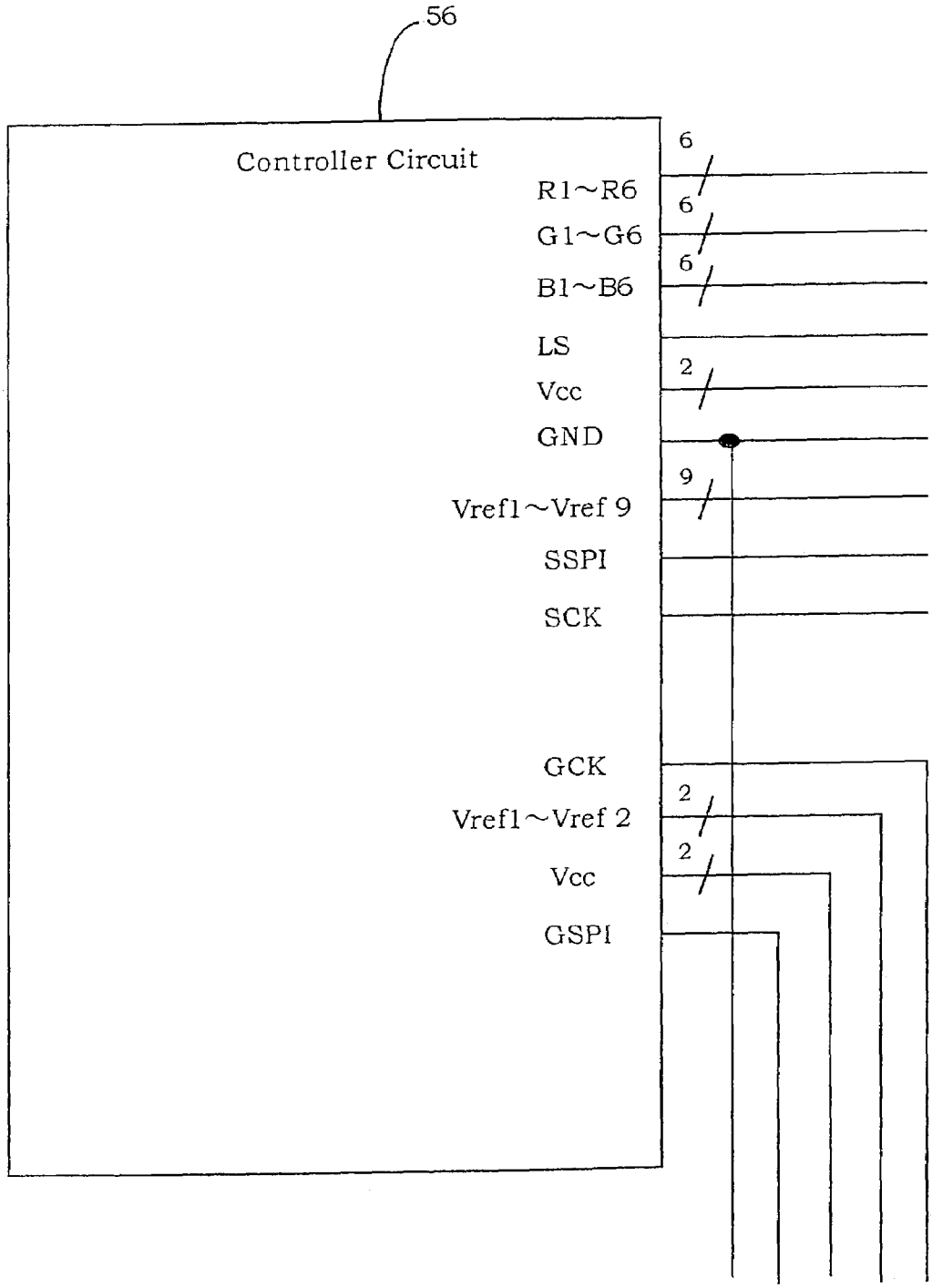
Fig. 9 Prior Art
FIG. 9 is an explanatory diagram of output terminals of a conventional controller circuit.

The R-circuit block 230 includes an R-shift register circuit 20R, an R-sampling memory circuit 22R, an R-hold memory circuit 23R, an R-D/A converter circuit 27R and an R-output circuit 28R. These are the same as the conventional ones shown in FIG. 8. The R-circuit block 230 according to this embodiment may be used only for processing red data.

The green region 350G and the blue region 350B include the same components as those in the circuit block in the red region 350R as described above. However, display data to be input is for green and for blue. The circuit blocks perform processing for driving green and blue display elements, respectively.

In other words, the green region 350G includes a G-circuit block 260, a data latch circuit (G) 21G, and a reference voltage generating circuit (G) 25. The blue region 350B includes a B-circuit block 290, a data latch circuit (B) 21B and a reference voltage generating circuit (B) 26.

Figure 4:
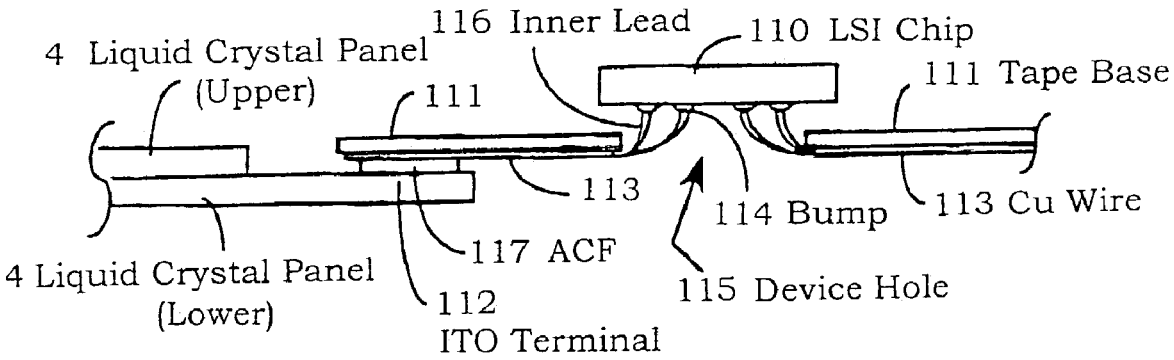
FIG. 4 is a section view showing a connection between a liquid crystal panel and a TCP according to the embodiment of the present invention.

FIG. 4 is a section diagram schematically showing wire connection between the liquid crystal panel and TCP's according to this embodiment of the present invention.

FIG. 4 mainly shows wires connecting an LSI chip 110 including the source driver 1 and the liquid crystal panel 4. The liquid crystal panel 4 includes an upper panel and a lower panel in general. An ITO terminal 112 is provided on one (the lower panel 4 in FIG. 4) of the panels.

The LSI chip 110 is located at a position corresponding to a through-hole (device hole) 115 in a tape base 111, which is the TCP 3. A Cu wire 113 is provided on one surface of the tape base 111 for connecting the bumps 114 on the output terminals of the LSI chip 110 of the source driver 1 and the ITO terminal 112 of the liquid crystal panel 4.

The bumps 114 and the Cu wire 113 are electrically connected through inner leads 116. Furthermore, the Cu wire 113 and the ITO terminal 112 are press-fitted and are electrically connected through an anisotropic conductive film (ACF) 117, for example.

A bump array on the LSI chip 110 is also included within the chip 110. Thus, the lengths of the inner leads 116 are different from each other. The flexible substrate 5, not shown in FIG. 4, and the LSI chip 110 are electrically connected through the right Cu wire 113. The right Cu wire 113 on the tape base 111 and the flexible substrate 5 are connected through AGF or soldering.

The region of the TCP 3 including the LSI chip 110 is preferably covered by an encapsulating resin, not shown, in order to protect the LSI chip 110.

With the wiring shown in FIG. 4, the display data signals output from the controller 6, for example, pass through the predetermined right Cu wire 113 and the right side inner lead 116, bump 114, source driver chip 110, the left side bump 114 and inner lead 116 and the left side Cu wire 113 on the tape base 111, ACF 117 and ITO terminal 1 12. Then, the display data signals are supplied to the liquid crystal panel 4.

Various kinds of control signal power supply (GND and VCC) are supplied to the source drivers 1 and the gate drivers 2 through the same wiring path. For example, display data signals (R, G and B), start pulse input signals SSPI and clock signals SCK are supplied from the controller 6 to the eight source drivers 1 (S1 to S8) in FIG. 1. Start pulse input signals GSPI and clock signals GCK are supplied from the controller 6 to the two gate drivers 2 (G1 and G2) in FIG. 1. Having described the connection through a TCP including a source driver, completely the same connection method using inner leads, ACP and so on may be applied to the gate drivers 2.

When the source side and gate side of the liquid crystal panel 4 have 1024 pixels ×3 (RGB) and 768 pixels, respectively, like the conventional technology, each of the eight source drivers (S1 to S8) is responsible for 128 pixels ×3 (RGB) to drive the display.

When 6-bit display data signals are provided for each color, six signal lines for each color are connected to the source driver 1. In other words, a total of 18 display data signals including red display data signals (R1 to R6), green display data signals (G1 to G6) and blue display data signals (B1 to B6) are input to the source driver 1.

Figure 5:
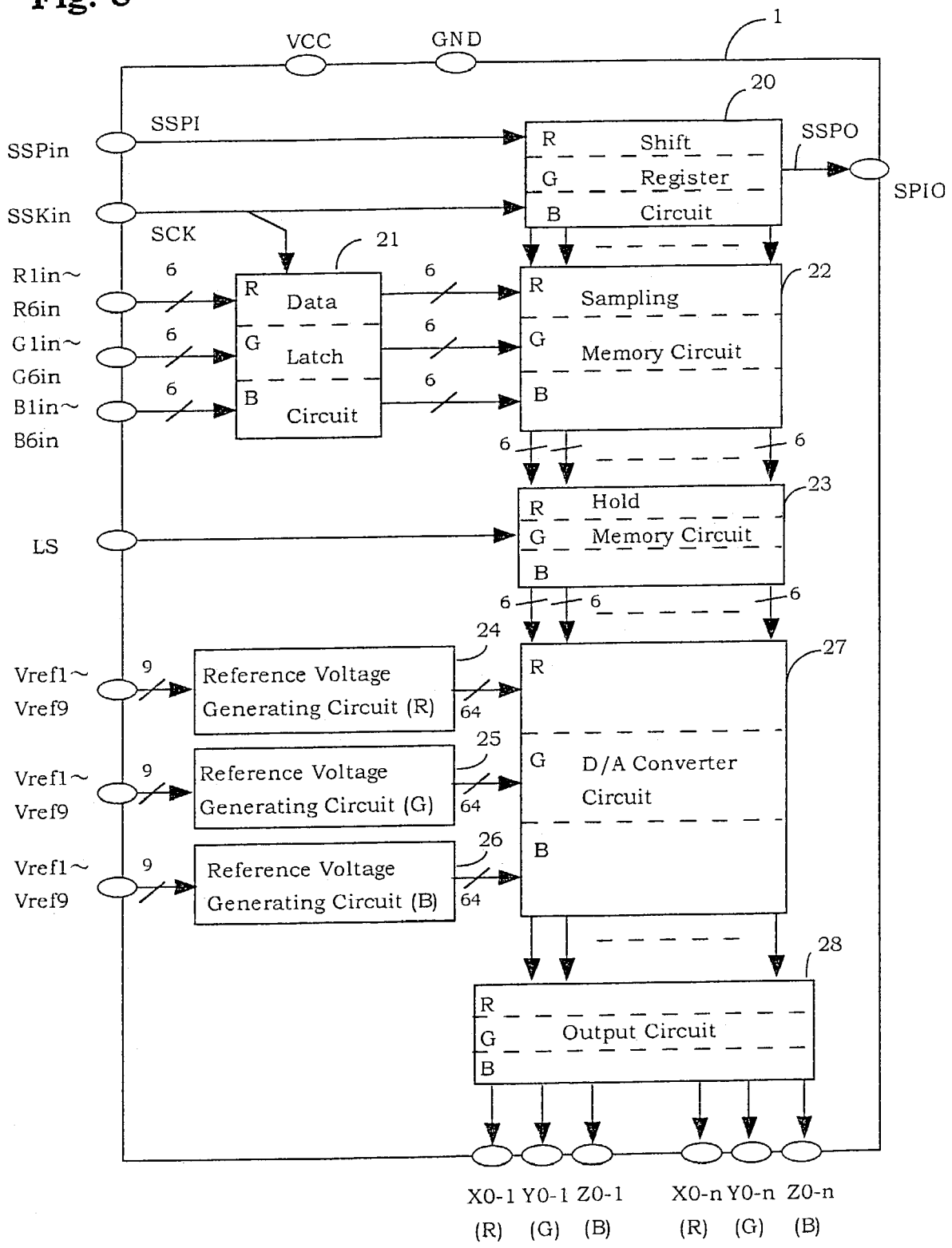
FIG. 5 is a diagram showing a construction of circuit blocks inside the source driver according to the embodiment of the present invention.
Figure 10:
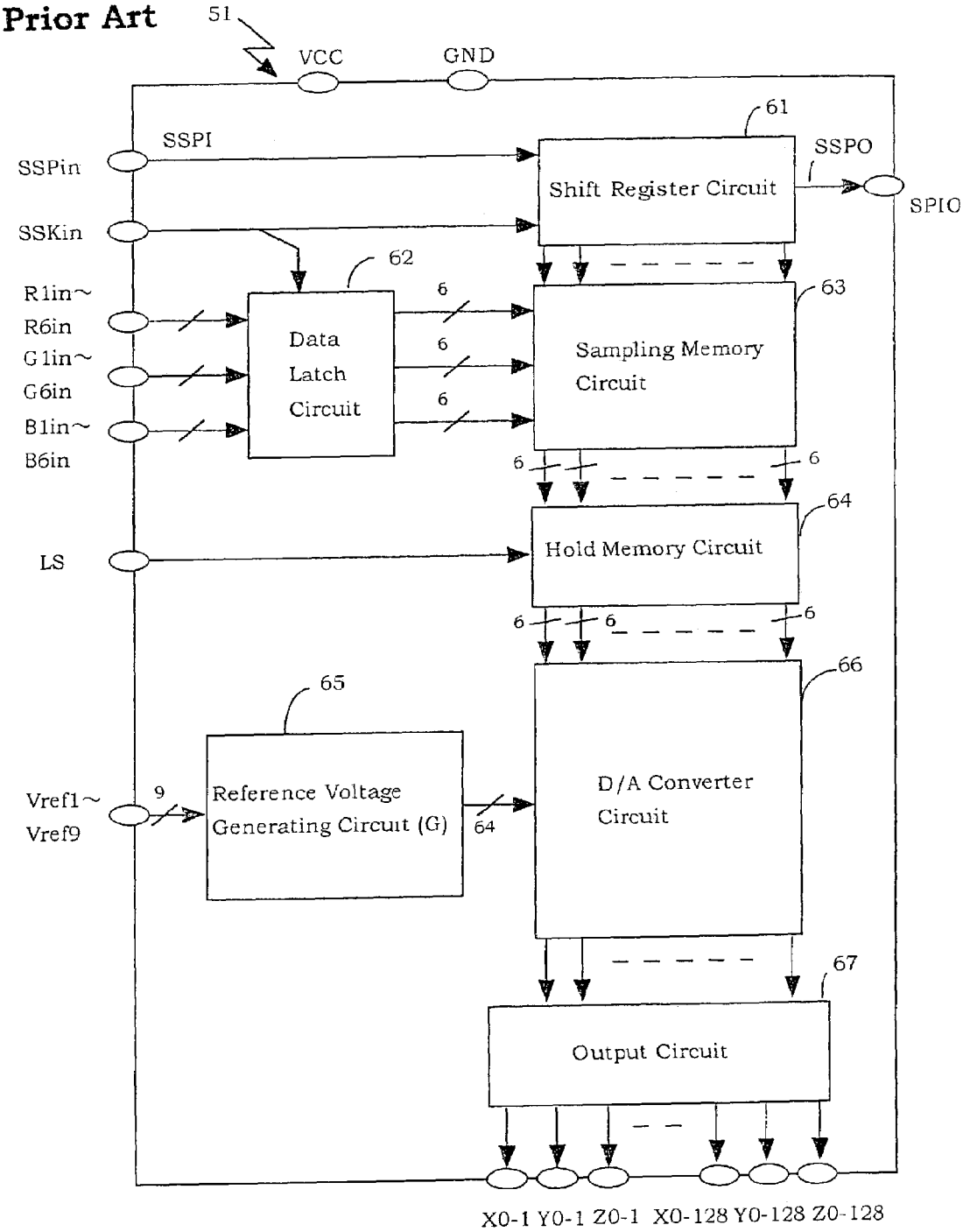
Fig. 10 Prior Art
FIG. 10 is a diagram showing a construction of circuit blocks of the conventional source driver.

FIG. 5 shows a functional construction diagram of circuit blocks of the source driver 1 according to the invention. In FIG. 5, the source driver 1 according to the invention functionally has the same construction as that of the conventional source driver shown in FIG. 10.

Conventionally, signals for all of the three primary colors are processed by one circuit in each circuit block. However, according to the present invention, each circuit block is physically divided into three. Then, separate signal processing for three primary colors R, G and B is performed in each of the divided circuit blocks. The arrangement of each of the physically divided circuit blocks is as shown in FIG. 3.

Therefore, for example, the shift register circuit 20 includes three physically different shift register circuits 20R, 20G and 20B. Start pulse input signals SSPI and clock signals SCK from the controller 6 are supplied to these three shift resistor circuits 20R, 20G and 20B.

Similarly, each of the circuits including the sampling circuit 22 is physically divided into three for R, G and B. As shown in FIG. 5, the source driver 1 includes three sampling circuits 22R, 22G and 22B, hold memory circuits 23R, 23G and 23B, D/A converter circuits 27R, 27G and 27B, output circuits 28R, 28G and 28B, data latch circuits 21R, 21G and 21B and reference voltage generating circuits 24, 25 and 26.

Display data signals R1 to R6, G1 to G6 and B1 to B6 are supplied to the three data latch circuits 21R, 21G and 21B, respectively. The same reference voltages Vref1 to Vref9 are supplied to each of the reference voltage generating circuits 24, 25 and 26 separately.

The start pulse input signals SSPI to be supplied to the three shift resistor circuits 20 are synchronized with horizontal synchronous signals of display data signals R, G and B as conventional. The start pulse input signals SSPI are shifted based on clock signals SCK input to the clock signal terminal SCKin, are output from the SPIO terminal and are transferred up to the eighth source driver S8.

The display data signals R, G and B to be supplied from the controller circuit 6 to the three data latch circuits 21R, 21G and 21B are synchronized with a rising edge of an invert signal (/SCK) of the clock signal SCK and are input to the input terminals R1in to R6in, G1in to G6in and B1in to B6in of the source driver 1, respectively, in series. Then, the display data signals R, G and B are supplied to the physically divided data latch circuits 21R, 21G and 21B and are temporarily latched therein. After that, the display data signals R, G and B are transferred to the sampling memory circuits 22R, 22G and 22B, respectively.

The sampling memory circuit 22 samples the display data signals (that is, R, G and B signals of 6 bits each and 18 bits in total) sent in a time-division manner from output signals of all stages of the shift register circuit 20. The sampling memory circuit 22 stores the display data signals until a latch signal LS is input from the controller circuit 6 to the hold memory circuit 23.

When the latch signal LS is input to the hold memory circuit 23, the display data signals stored in the sampling memory circuit 22 are input to the hold memory circuit 23. Thus, the display data signals for one horizontal period of the display data signals R, G and B are latched. When the display data signals for the next one horizontal period are input from the sampling memory circuit 22, the held display data signals are output to the D/A converter circuit 27.

The reference power supply generating circuits 24, 25 and 26 for the three primary colors R, G and B generate voltages for gray-scale display for respective γ-corrected colors based on halftone reference voltages Vref1 to Vref9, respectively, supplied from the controller circuit 6. Then, the gray-scale display voltages are supplied to the respective D/A converter circuits 27R, 27G and 27B.

Each of the gray-scale display voltages generated here includes 64 levels. The reference voltage generating circuits 24, 25 and 26 and the D/A converters 27R, 27G and 27B are connected through sets of 64 wires, respectively.

These nine halftone reference voltages Vref1 (V0) to Vref9 (V63) supplied from the controller circuit 6 are the same voltage values as the conventional voltage values.

Figure 11:
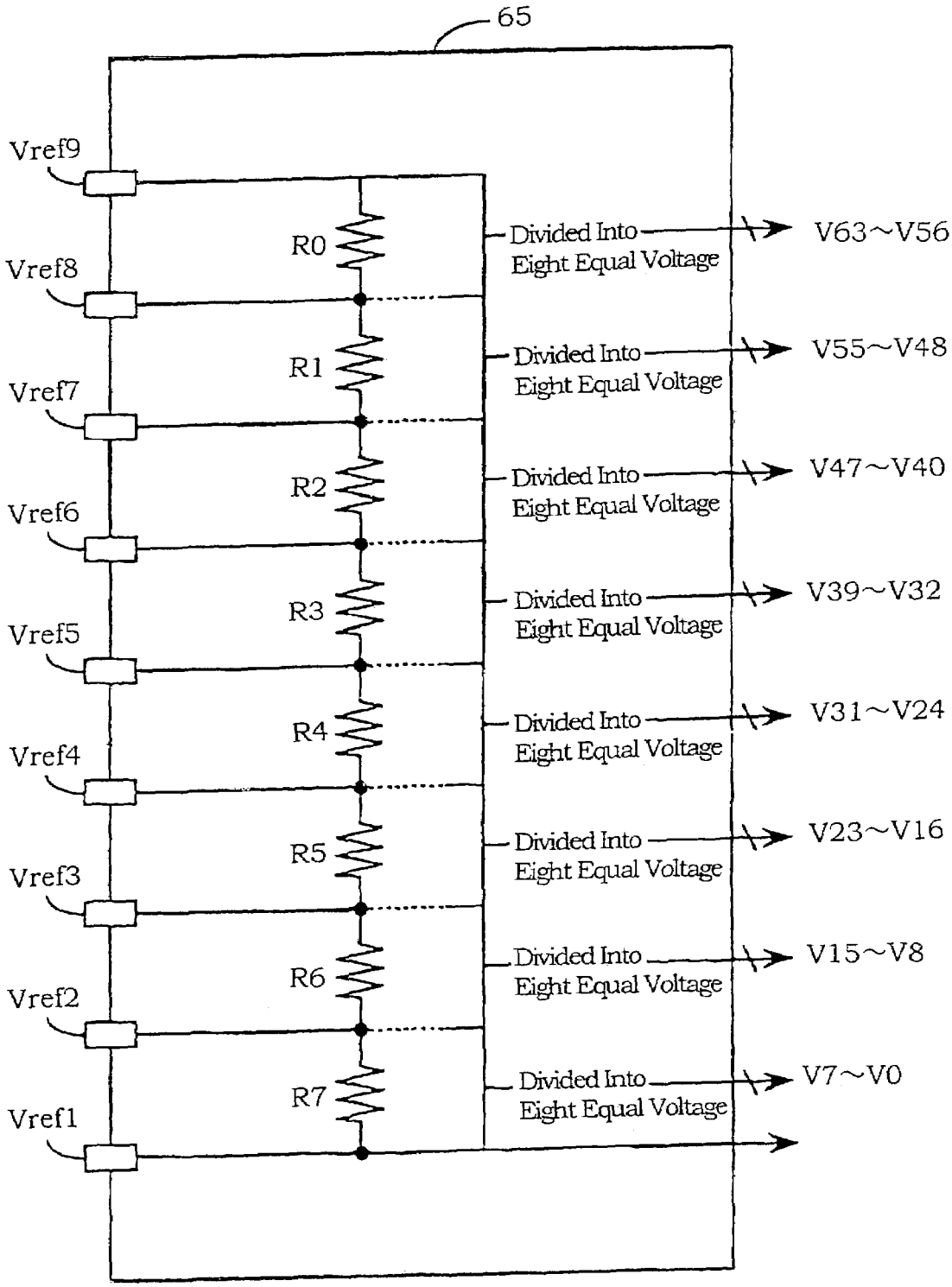
Fig. 11 Prior Art
FIG. 11 is a block diagram showing a construction of the inside of a conventional reference voltage generating circuit.
Figure 12:
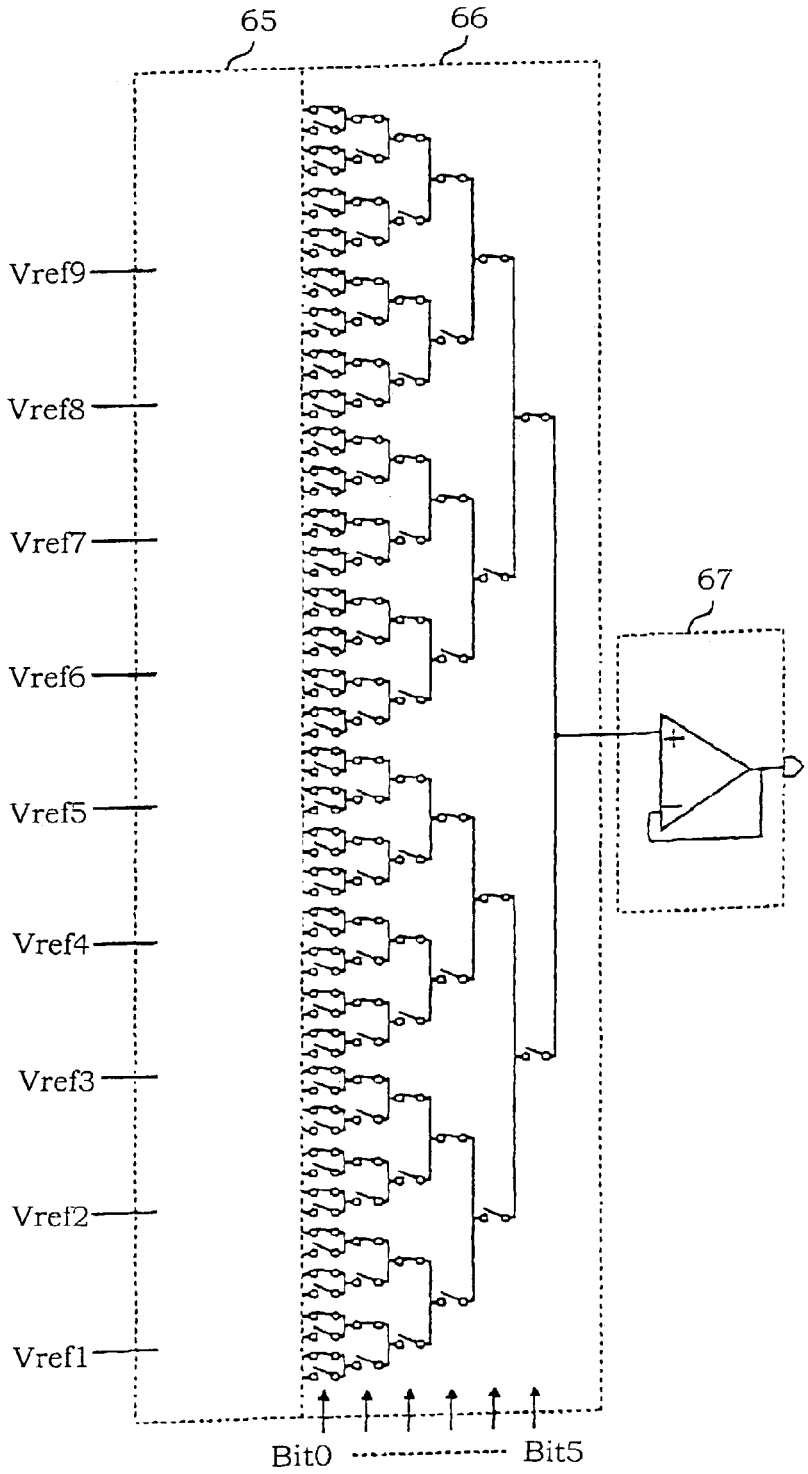
Fig. 12 Prior Art
FIG. 12 is a schematic diagram showing a construction of a conventional D/A converter circuit and output circuit.
Figure 13:
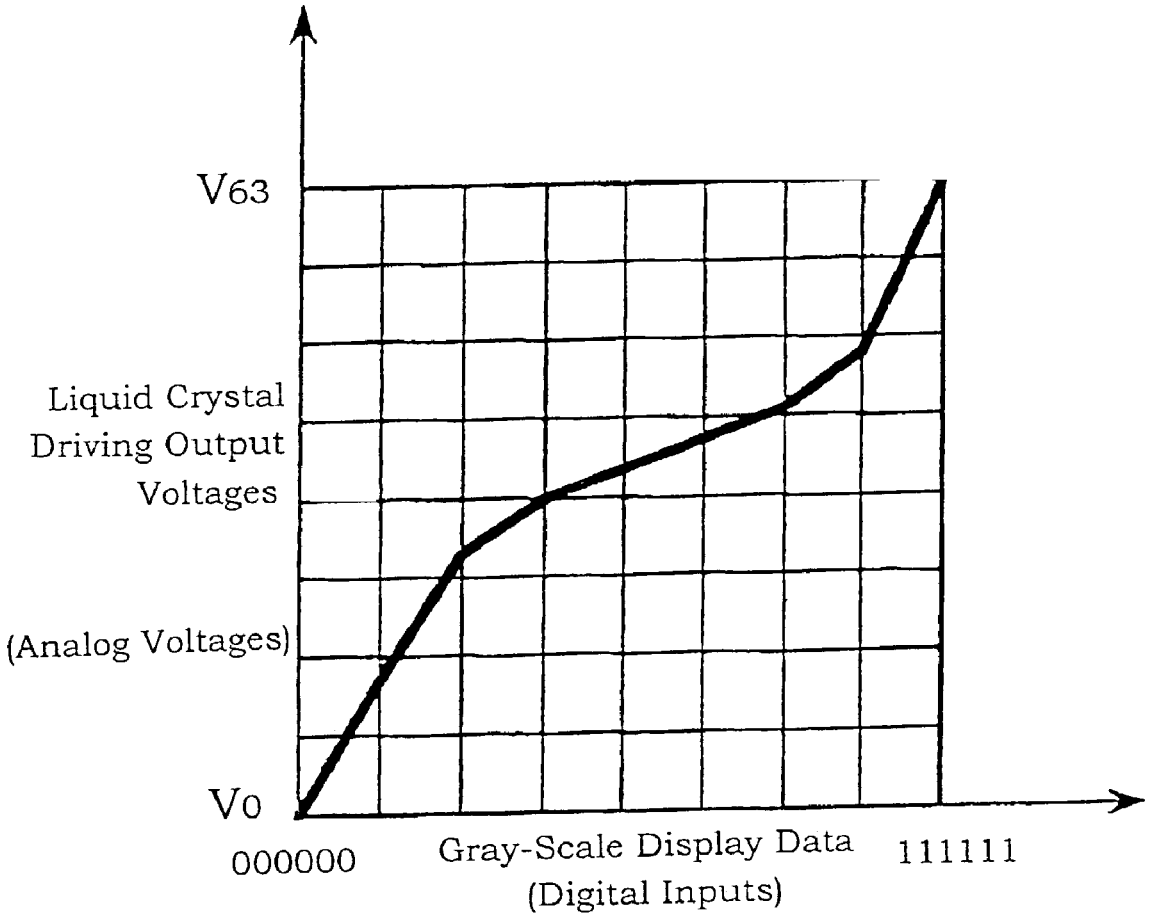
Fig. 13 Prior Art
FIG. 13 is a graph of a gray-scale voltage characteristic of the conventional source driver.

The inside of each of the reference voltage generating circuits 24, 25 and 26 may be the same as the conventional circuits shown in FIG. 11. In other words, resistance elements R0 to R7 are provided therein which have resistance ratios for γ correction and which are connected in series. In order to achieve natural gray-scale display in accordance with the optical characteristic of a liquid crystal material, γ-corrected, 64 levels of grays-scale display reference voltage are generated.

The D/A converter circuit 27 converts the respective R, G and B display data signals (digital) of 6 bits each input from the hold memory circuit 23 to analog signals and outputs the analog signals to the output circuit 28. The output circuit 28 amplifies the 64 level analog signals and outputs them to ITO terminals, not shown, of the liquid crystal panel 4 through output terminals Xo-1 to Xo-128, Yo-1 to Yo-128 and Zo-1 to Zo-128. The output terminals Xo-1 to Xo-128, Yo-1 to Yo-128 and Zo-1 to Zo-128 correspond to R, G and B display data signals, respectively, and each of the Xo, Yo and Xo sets includes 128 terminals.

The terminal VCC and terminal GND of the source driver 1 are connected to the terminal VCC and terminal GND of the controller circuit 6 for power supply. Power supply voltage and ground potential are supplied to the terminal VCC and terminal GND of the source driver 1, respectively.

According to the invention, physically separated display driving circuit element regions are provided for a plurality of display data, respectively, which are input to the driving device for a display apparatus according to the invention. Electrode pads connected to the display apparatus, such as a liquid crystal panel, are provided near each circuit block in the circuit element region. Thus, the ratio of the long side to short side (long side/short side) of the rectangular LSI device can be suppressed not to be excessively large. Therefore, even when the number of output terminals to a display apparatus is increased for increasing a screen size, the LSI device does not have a long and narrow rectangular form.

Especially, in the liquid crystal display apparatus for handling display data for three primary colors, a display driving circuit element region is divided so as to correspond to the colors. Then, the divided display driving circuit element regions corresponding to the colors, respectively, are aligned in a direction of the short side of the rectangular form. Therefore, the length of the long side of the rectangular form is prevented from increasing excessively.

For example, a liquid crystal panel has 3N pixels in a long-side direction (horizontal direction), the length of the long side of the rectangular liquid crystal panel is 3N×a (where a is a length of a circuit block for one pixel in the long side direction) conventionally. The length of the short side is b (where b is a length of the circuit block for one pixel in the short side direction) conventionally. However, according to the present invention, the length of the long side is N×a while the length of the short side is 3*b*.

In other words, the conventional driving device has the ratio of the long side/short side=(3N×a)/b, which is significantly large. On the other hand, the driving device according to the present invention has the ratio of the long side/short side=(N×a)/(3*b*). In this case, the ratio of the long side/short side is reduced. Thus, the device can be prevented from being excessively long and narrow.

According to the present invention, the display driving circuit element region is divided for the three primary color components, respectively. Thus, each color can be γ-corrected. In accordance with the optical characteristic of a liquid crystal material, images can be displayed in more proper and natural gray-scales.

Especially, reference voltage generating circuits are provided for the color components, respectively. Thus, the γ-correction can be defined in detail. Therefore, display quality with an increased number of pixels for a larger screen size can be improved.

The driving device for a display apparatus according to the present invention can be used as a driving display for a liquid crystal panel as described in the embodiment. Furthermore, the present invention can be applied to a driving device for other display apparatus than the liquid crystal panel. In particular, when the present invention is applied to the driving device having many output terminals to a display apparatus and having a long and narrow form, the ratio of long side/short side can be reduced.

In the above-described embodiment, a source driver is provided on a TCP as a typical example of the driving device for a display apparatus. However, an LSI-chipped driving device may be directly implemented on a liquid crystal panel without using the TCP. In this case, bumps on the output terminals of the source drivers according to the embodiment and ITO terminals of the liquid crystal panel may be thermally press-fitted and be electrically connected through an ACF.

According to the present invention, each separate display driving circuit element region is provided for each of a plurality of input display data. Therefore, the device form can be prevented from being long and narrow. The γ-correction can be performed on each of the display data. As a result, images can be displayed in more proper and natural gray-scales.

Especially, when the number of pixels are increased in order to meet the requests for an increase in screen size and so on, the long and narrow device form can be prevented. In addition, the display quality can be significantly improved with respect to γ-correction.

What is claimed is:

1. A driving device for a display apparatus, comprising:

a plurality of display driving circuit element regions physically separated from one another and each for a plurality of display data, each of the display driving circuit element regions including at least:

a display data capturing portion for capturing display data corresponding to the region, a holding portion for latching the captured display data for a given period of time;

a reference voltage generating portion for generating a given number of reference voltages for gray-scale display, a selecting portion for selecting a reference voltage corresponding to the latched display data from the generated reference voltages for gray-scale display, and a plurality of terminals including a pair of reference power supply terminals arranged between two pairs of output terminals along a top surface of each display driving circuit element region, and including two pairs of data input terminals arranged along a bottom surface of each display driving circuit element region, and wherein the reference voltage selected for each of the plurality of display data is output to the display apparatus as a display driving signal.

2. The driving device of claim 1, wherein the display data capturing portion, holding portion, reference voltage generating portion and selecting portion are physically separated from one another in each of the display driving circuit element regions.

3. The driving device of claim 2, wherein the driving device is embodied as a substantially rectangular-shaped semiconductor device having a long side and short side, and the display device circuit element regions are aligned in parallel in a direction of the short side.

4. The driving device of claim 3, wherein, in each of the display driving circuit element regions, the display data capturing portion, holding portion, reference voltage generating portion and selecting portion are aligned in parallel in the direction of the short side.

5. The driving device of any one of claims 1 to 4, wherein the plurality of display data are classified according to color components, and the display driving circuit element regions are physically separated for processing a corresponding one of the color components.

6. The driving device of claim 5, wherein the reference voltage generating portion includes three voltage correcting portions physically separated for three primary color components, and each of the voltage correcting portions generates a plurality of reference voltages for gray-scale display which are γ-corrected for the color component corresponding to the voltage correcting portion by using input halftone reference voltages.

7. The driving device of claim 6, wherein each of the voltage correcting portions includes a plurality of serially-connected resistance elements which have given resistance ratios for v-correcting the input halftone reference voltages.

8. The driving device of claim 5, wherein, for each of the separate display driving circuit element regions separated for the color components:

the data input terminals input display data of the corresponding color component to be processed by circuit elements of the corresponding region, the reference power supply terminals input a halftone reference voltage, and the output terminals output an analog value of a γ-corrected reference voltage for gray-scale display.

9. A display apparatus comprising a driving device for a display apparatus according to any one of claims 1 to 4.

10. A display apparatus comprising a driving device for a display apparatus according to claim 5.

11. A display apparatus comprising a driving device for a display apparatus according to claim 6.

12. A display apparatus comprising a driving device for a display apparatus according to claim 7.

13. A display apparatus comprising a driving device for a display apparatus according to claim 8.

14. A driving device for a display apparatus, comprising:

a plurality of display driving circuit element regions physically separated from each other, each display circuit element region dedicated to processing one of three primary color component for display, each display driving circuit element regions including:

a display data capturing portion for capturing display data of its corresponding color component, a holding portion for latching the captured color component display data, a reference voltage generating portion for generating a plurality of reference voltages for gray-scale display, a selecting portion for selecting, from the generated plurality of reference voltages, a reference voltage corresponding to the latched color component display data, and a plurality of terminals including a pair of reference power supply terminals arranged between two pairs of output terminals along a top surface of each display driving circuit element region, and including two pairs of data input terminals arranged along a bottom surface of each display driving circuit element region.

* * * * *